United States Patent [19]

Hamada

[11] 4,179,969

[45] Dec. 25, 1979

[54] TONE GENERATOR FOR ELECTRICAL MUSIC INSTRUMENT

[75] Inventor: Osamu Hamada, Tokyo, Japan

[73] Assignee: Sony Corporation, Tokyo, Japan

[21] Appl. No.: 941,061

[22] Filed: Sep. 11, 1978

[30] Foreign Application Priority Data

Sep. 12, 1977 [JP] Japan ..... 52-109632
Sep. 26, 1977 [JP] Japan ..... 52-115335

[51] Int. Cl.[2] ..... G10H 1/04; G10H 5/00

[52] U.S. Cl. ..... 84/1.01; 84/1.26; 84/DIG. 20; 84/DIG. 8

[58] Field of Search ..... 84/DIG. 8, 1.01, 1.03, 84/1.24, 1.26, DIG. 2, DIG. 20

[56] References Cited

U.S. PATENT DOCUMENTS

| | | | |
|---|---|---|---|
| 3,760,358 | 9/1973 | Isii et al. | 84/DIG. 2 |
| 3,986,423 | 10/1976 | Rossum | 84/1.03 |
| 4,073,209 | 2/1978 | Whittington et al. | 84/1.03 |
| 4,077,298 | 3/1978 | Kondo | 84/454 |

*Primary Examiner*—B. Dobeck

*Attorney, Agent, or Firm*—Lewis H. Eslinger; Alvin Sinderbrand

[57] ABSTRACT

In a tone generating apparatus for an electrical music instrument having an array of switches corresponding to respective keys of a keyboard and which are selectively actuable by manipulation of the respective keys, a timing signal generator, preferably including a shift register, has a repetitive operating cycle and is connected with the switches for providing timing signals in response to actuation of the latter, with each of the timing signals occurring at a time during the operating cycle which corresponds to the position of the respective actuated switch in the switch array, an exponential signal generator provides an exponential signal in synchronism with the operating cycle of the timing signal generator, a sample and hold circuit receives the exponential signal and is operative to sample and hold a value of the exponential signal in dependence on the time of occurrence of a timing signal in the operating cycle, and variable frequency oscillator controlled in accordance with the value of the exponential signal which is sampled and held for providing an output oscillation having a frequency determined by a selectively actuated one of the switches.

16 Claims, 28 Drawing Figures

FIG. 1
PRIOR ART
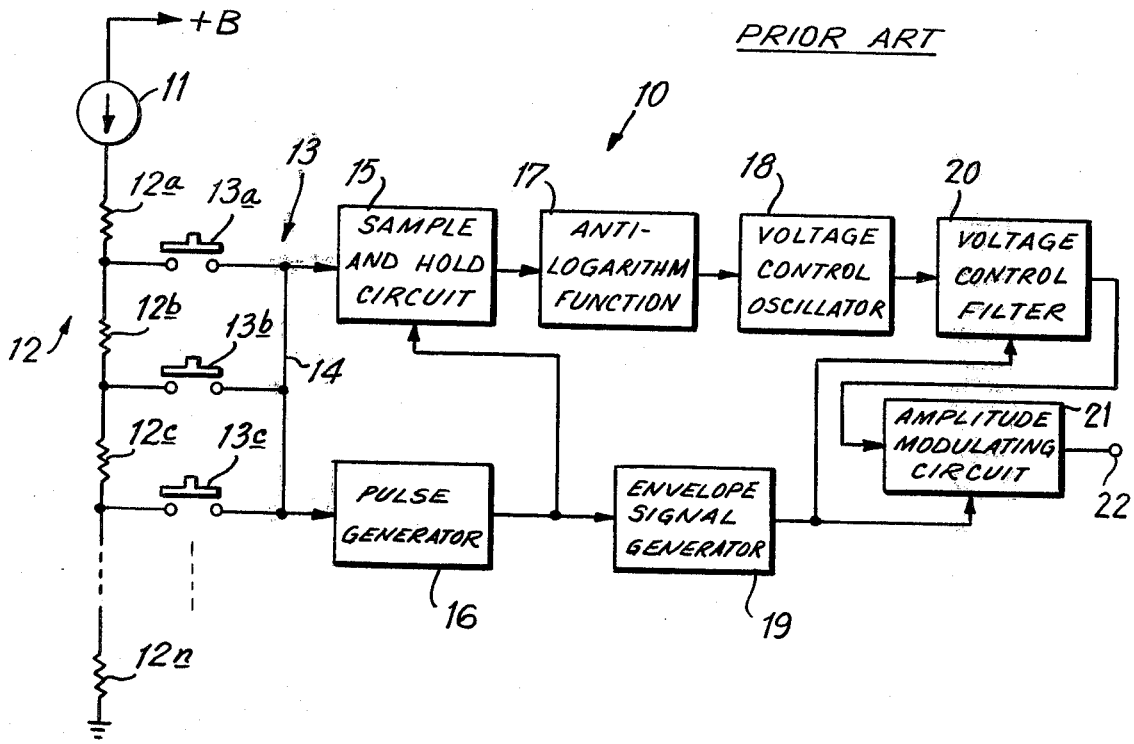
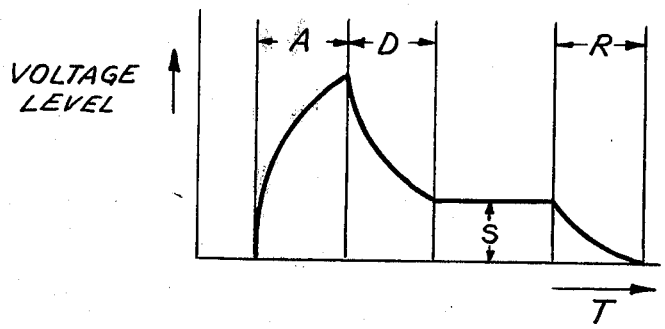
FIG. 2
PRIOR ART

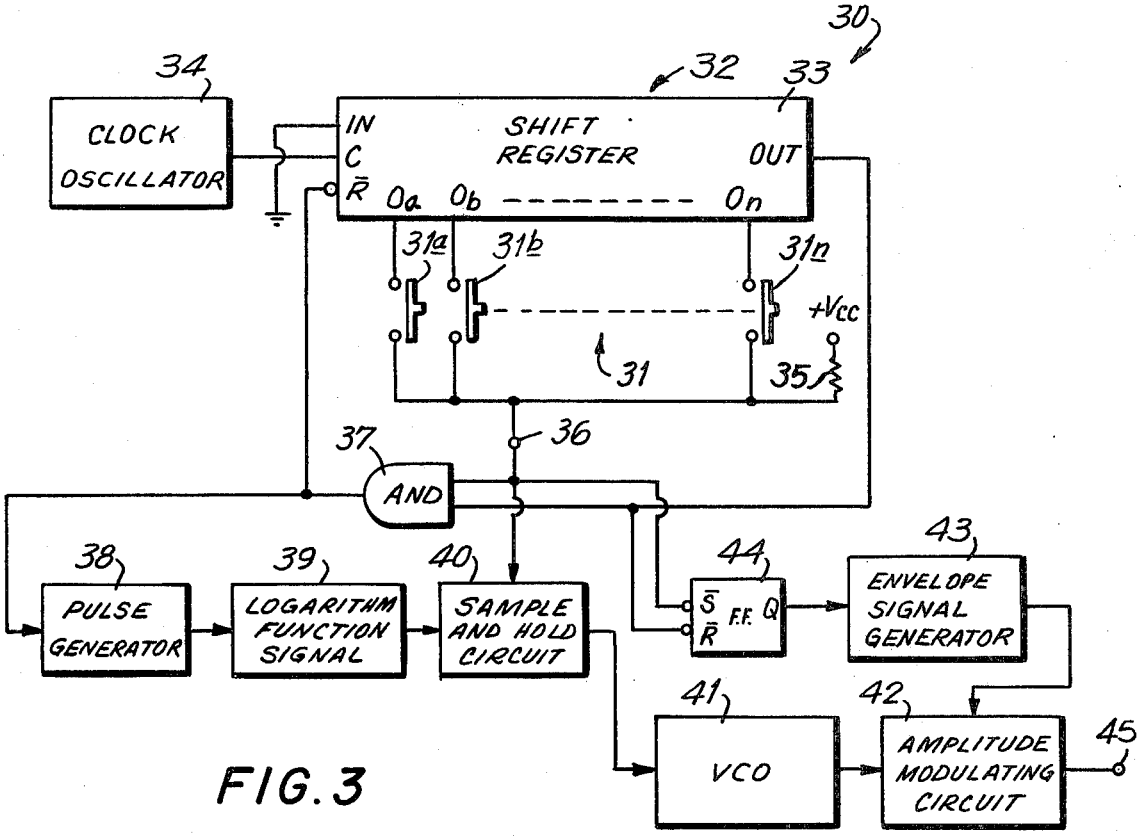
FIG. 3
FIG. 4
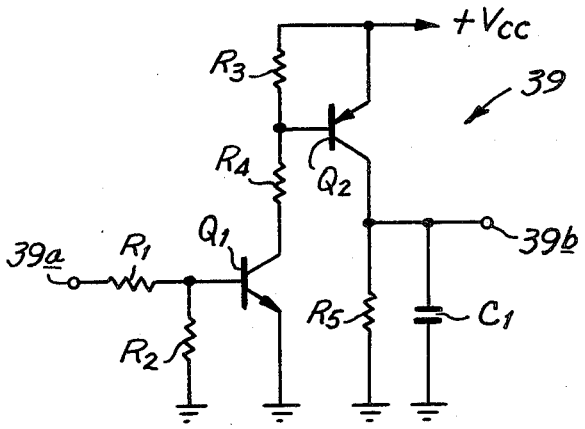

TONE GENERATOR FOR ELECTRICAL MUSIC INSTRUMENT

BACKGROUND OF THE INVENTION

1. Field of the Invention

This invention relates generally to a tone generator for an electrical music instrument or synthesizer, and more particularly is directed to an improved tone generator for an electrical music instrument or synthesizer of the single tone-type, that is, one in which, at any time, only a single tone signal or frequency is generated in correspondence to a key-operated switch which is then actuated.

2. Description of the Prior Art

Electrical music instruments or synthesizers have been provided which include a plurality of keys arrayed to form a keyboard, and a tone generator which generates tone signals corresponding to the keys which are selectively actuated or operated. In existing electrical music instruments, the tone generator includes a voltage divider connected with a DC power supply and with a plurality of switches actuable by respective keys of the keyboard to provide an output voltage corresponding to the position of the operated key in the keyboard. The voltage thus obtained is sampled and held to provide a corresponding substantially stabilized DC voltage which is supplied to an anti-logarithm function or exponential signal generator. The anti-logarithm function or exponential signal generator is designed to convert the DC voltage signal which varies linearly in dependence on the position of the respective operated key in the keyboard to a DC voltage signal which varies in accordance with the frequencies of the twelve tone steps comprising one octave. The resulting voltage from the anti-logarithm function or exponential signal generator is applied to a voltage controlled oscillator so that the latter provides an output oscillation or tone signal having a frequency determined by the switch which is selectively actuated by operation of the respective key. The output oscillation is then amplitude modulated by a suitable envelope signal which determines the quality of the synthesized tone.

The conventional tone generator for an electrical music instrument, as described above, has a number of disadvantages. More specifically, the described tone generator is susceptible to misoperation by reason of possible chattering of the switch which is actuated for selecting the output frequency or tone. Moreover, the anit-logarithm function or exponential signal generator used in the conventional tone generator employs the exponential function characteristic or relation to the base-emitter voltage to the collector current ($V_{BE}$-$I_C$) of a transistor, which characteristic varies with changes in temperature. Thus, the output frequency or tone obtained in response to the operation of a selected key of the keyboard may vary with changes in ambient temperature.

Further, when playing an electrical music instrument of the single-tone type, there is likely to be some overlapping of the periods during which successively operated keys are depressed, on other words, at any one time two or more keys may be depressed so as to simultaneously actuate the respective switches. In such case, the conventional tone generator for a single tone electrical music instrument will always give priority to either the higher or lower one of the output tones or frequencies respectively corresponding to the simultaneously actuated switches. In other words, if the conventional tone generator is designed to give priority to the lower tone or frequency and the operator first operates a key corresponding to a lower tone and then operates or depresses a key corresponding to a higher tone without fully releasing the earlier operated key, the relatively lower tone or frequency will be reproduced during the simultaneous operation of both keys. Contrary to the foregoing, in a single tone electrical music instrument, it is desirable that the output from the music instrument always correspond to the latest operated key. The conventional tone generator for an electrical music instrument is still further disadvantageous in that the envelope signal by which the output tone or frequency is amplitude modulated for determining the quality of the output oscillation or tone signal may not be reliably produced during legato playing of the instrument.

OBJECTS AND SUMMARY OF THE INVENTION

Accordingly, it is an object of this invention to provide a tone generator for an electrical music instrument which avoids the above-described problems encountered in the prior art.

More specifically, it is an object of this invention to provide a tone generator for an electrical music instrument which includes an array of switches actuable in response to operation or depressing of respective keys of a keyboard, and which avoids misoperation due to chattering of the switches.

Another object is to provide a tone generator for an electrical music instrument, as aforesaid, in which the frequency of the generated tone or signal is substantially independent of changes in the ambient temperature.

A further object is to provide a tone generator for an electrical music instrument, as aforesaid, in which, when a plurality of keys are operated or depressed in sequence for periods that overlap, the output tone or frequency always corresponds to the latest depressed or operated key.

A still further object of the invention is to provide a tone generator for an electrical music instrument, as aforesaid, in which the quality of the output tone or frequency is reliably determined by a suitable envelope signal which amplitude modulates the generated frequency or tone even during legato playing of the instrument.

In accordance with an aspect of this invention, a tone generator for an electrical music instrument of the single tone type comprises an array of switches corresponding to respective keys of a keyboard and which are selectively actuable by manipulation of the respective keys, a timing signal generator, preferably including a shift register, having a repetitive operating cycle and being connected with the switches for providing timing signals in response to actuation of the latter, with each of the timing signals occurring at a time during the operation cycle which corresponds to the position of the respective actuated switch in the switch array, an exponential signal generator providing an exponential signal in synchronism with the operating cycle of the timing signal generator, sample and hold means receiving the exponential signal and each timing signal and being operative to sample and hold a value of the exponential signal in dependence on the time of occurrence of the timing signal in the operating cycle, and variable frequency oscillating means controlled in accordance with the value of the exponential signal which is sampled and held for providing an output oscillation or tone signal having a frequency determined by a selectively actuated one of the switches.

The above, and other objects, features and advantages of the present invention, will be apparent in the following detailed description of illustrative embodiments thereof which is to be read in connection with the accompanying drawings.

BRIEF DESCRIPTION OF THE DRAWINGS

FIG. 1 is a block diagram showing a tone generator for an electrical music instrument according to the prior art;

FIG. 2 shows the waveform of an envelope signal which is employed in the tone generator shown in FIG. 1;

FIG. 3 is a block diagram showing a tone generator for an electrical music instrument of the single-tone type in accordance with an embodiment of the present invention;

FIG. 4 is a circuit diagram showing a preferred logarithm function signal generator that may be used in the tone generator of FIG. 3;

DESCRIPTION OF PREFERRED EMBODIMENTS

Figures 6A, 6B, 6C, 6D, 6E, 6F, 6G:
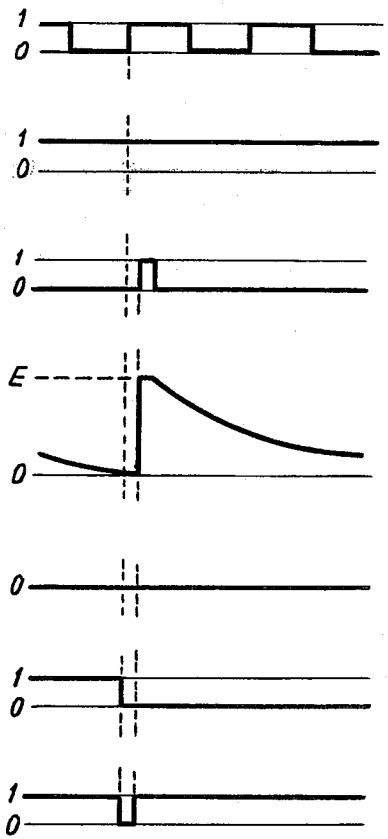
FIGS. 5A–5G and FIGS. 6A–6G are waveform diagrams to which reference will be made in explaining the operation of the tone generator illustrated in FIG. 3.

Referring to the drawings in detail, a typical tone generator 10 for an electrical music instrument according to the prior art will first be described with reference to FIG. 1 as a means of furthering understanding of the problems to be solved by the invention. Such tone generator 10 is shown to comprise a constant current source 11 connected to a DC power supply +B for supplying a constant current to a voltage divider 12 comprised of a plurality of resistors 12*a*, 12*b*, 12*c*, - - - 12*n*, having the same resistance values and being connected in series between current source 11 and ground. A plurality of normally open switches 13*a*, 13*b*, 13*c*, etc., which are selectively actuable or closed in response to operation or depression of respective keys (not shown) of a keyboard are arranged in a parallel array 13 between respective resistors of voltage divider 12 and a common bus or connection 14. In other words, as shown, switches 13*a*, 13*b*, 13*c*, etc. are connected at one end to the junctions between resistors 12*a*, 12*b*, 12*c*, etc., respectively, and the next resistors in the series, while the other sides of switches 13*a*, 13*b*, 13*c*, etc. are connected to the common connection or bus 14 and, by way of the latter, to inputs of a sample and hold circuit 15 and a pulse generator 16. It will be appreciated that the closing of any one or normally open switches 13*a*, 13*b*, 13*c*, etc., applies a voltage to pulse generator 16 by which the latter, preferably after a suitable delay, is made to produce a pulse signal applied to sample and hold circuit 15 for causing the latter to sample and hold the value of the voltage then being applied to circuit 15 by way of the closed switch of array 13.

With the arrangement shown on FIG. 1, it will be apparent that the closer to constant current source 11 is the closed switch of the array 13, the higher will be the voltage which is sampled and held by circuit 15. Thus, the switches 13*a*, 13*b*, 13*c*, etc. respectively correspond to decreasing voltage values, in the order named, and also to decreasing frequencies of the output signals from tone generator 10.

Since the successive resistors 12*a*, 12*b*, 12*c*, etc. of voltage divider 12 have equal resistance values, it will be apparent that the voltage applied to sample and hold circuit 15 will decrease or vary linearly in response to the closing or actuation of switches 13*a*, 13*b*, 13*c*, etc. in succession. Therefore, in the tone generator 10 according to the prior art, the output of sample and hold circuit 15 is applied to an anti-logarithm function signal generator 17 which converts the linearly varied voltage derived from circuit 15 in dependence on the position in array 13 of the closed switch into an anti-logarithm function signal or voltage corresponding to frequencies of the twelve tone steps comprising one octave. The resulting voltage from circuit 17 is applied to a voltage controlled oscillator 18 which generates an oscillation output having a frequency determined by the closed switch in array 13.

In the known tone generator 10, the pulse from pulse generator 16 is also applied to an envelope signal generator 19 which, in response thereto, produces an envelope signal, as shown on FIG. 2. The oscillation output of voltage controlled oscillator 18 is applied to a voltage controlled variable filter 20 which is under the control of the envelope signal from generator 19, and the resulting oscillation output from filter 20 is applied to a modulating circuit 21 to be amplitude modulated in the latter by the envelope signal from generator 19. The resulting output of modulating circuit 21 is applied to an output terminal 22 which may be connected through a suitable amplifier (not shown) to a speaker or the like. Thus, in response to actuation of any one of the switches in array 13, there is provided at output terminal 22 an oscillation signal having a frequency corresponding to the actuated or closed switch and a quality determined by the configuration of the envelope signal from generator 19. As shown on FIG. 2, the waveform of the envelope signal from generator 19 may be selected to provide various changes in amplitude during the attack time A, the decay time D and the release time R, while a desired sustained level S is maintained between the decay and release times.

It will be noted that, in the above-described conventional tone generator 10, a pulse from generator 16 occurs only after a suitable delay following the application of a voltage to generator 16 in response to closing of one of the switches in array 13. By reason of the foregoing delay, chattering of the actuated switch at the time of its closing will not cause misoperation, that is, the mentioned delay in the issuance of a pulse from generator 16 is sufficiently long to insure that initial chattering of the closed switch will have ceased and the voltage applied to sample and hold circuit 15 will have attained a stable level at the time when circuit 15 is activated by a pulse from generator 16. However, the delay inherent in the operation of pulse generator 16 will not prevent misoperation of tone generator 10 due to any later chattering of the closed switch in array 13. Moreover, the anti-logarithm function signal generator or converter 17 employs the exponential function characteristic or relation of the base-emitter voltage to the collector current ($V_{BE}$-$I_C$) of a transistor, which characteristic varies with changes in temperature. Thus, the voltage applied to voltage controlled oscillator 18 in response to the closing of any one of the switches in array 13 may vary with changes in ambient temperature and cause a corresponding variation in the frequency of the oscillation output or tone signal obtained from terminal 22.

It is further to be noted that, in the tone generator 10, if two of the keys in array 13 are closed simultaneously, the voltage applied to sample and hold circuit 15 will correspond to the voltage determined by the closed switch which is nearer to the ground. Thus, for example, if switches 13*a* and 13*c* are simultaneously closed, the voltage determined by the closing of switch 13*c* will be the voltage applied to sample and hold circuit 15 and, therefore, tone generator 10 will give priority to the closed switch corresponding to the lower frequency. It will be appreciated that, when playing an electrical music instrument of the single-tone type, there is likely to be some overlapping of the periods during which successively operated keys are depressed, in other words, at any one time two or more keys may be depressed so as to simultaneously actuate the respective switches. In such cases, the described tone generator 10 will always give priority to the lower one of the output tones or frequencies respectively corresponding to the simultaneously actuated switches. In other words, if the operator first depresses the key for closing switch 13*c* corresponding to a lower tone and then operates or depresses the key for closing switch 13*a* corresponding to a higher tone prior to fully releasing the earlier operated key, so that switches 13*a* and 13*c* are simultaneously closed or actuated, the relatively lower tone or frequency will be produced during the simultaneous closing of switches 13*a* and 13*c*, and the relatively higher tone or frequency will be obtained only when the key for closing switch 13*c* is eventually released. The foregoing will produce an unnatural effect in a single-tone electrical music instrument in which it is desired to change from the relatively low frequency or tone corresponding to switch 13*c* to the high frequency or tone corresponding to switch 13*a* as soon as the latter switch is actuated or closed even though the previously closed switch 13*c* has not yet been fully opened.

It is further to be noted that, during legato playing of a single-tone electrical music instrument having the described tone generator 10, the change from one tone or frequency to another occurs smoothly, that is, without interruption of the voltage applied to pulse generator 16 with the result that the latter may not be reliably triggered by the mere voltage changes to produce a pulse upon the closing of each of the switches in array 13 for activating envelope signal generator 19. Thus, the envelope signal by which the output tone or frequency is amplitude modulated in circuit 21 for determining the quality of the output oscillation or tone signal at terminal 22 may not be reliably produced during legato playing of the instrument.

Referring now to FIG. 3, it will be seen that a tone generator 30 for a single tone-type electrical music instrument according to an embodiment of this invention generally comprises an array 31 of switches 31*a*, 31*b*, - - - 31*n* corresponding to respective keys of a keyboard (not shown) and which are selectively actuable or closed by manipulation of the respective keys. A timing signal generator 32 is shown, in the illustrated embodiment, to include a shift register 33 having a clock input C receiving a clock pulse, for example, at a frequency of 50 KHz from a clock oscillator 34. The shift register 33 further has a series input terminal IN which is connected to ground, an inverted reset signal input terminal $\overline{R}$, a series output terminal OUT, and parallel output terminals $O_a$, $O_b$ - - - $O_n$. The normally open switches 31*a*, 31*b*, - - - 31*n* are shown to be connected, at one side, to the parallel output terminals $O_a$, $O_b$, - - - $O_n$, respectively, of shift register 33, while the opposite sides of the switches in array 31 are connected, in common, to a DC voltage supply $+V_{cc}$ through a resistor 35 and also to a timing signal output terminal 36. An AND logic circuit 37 has two inputs respectively connected to timing signal output terminal 36 and to series output terminal OUT of shift register 33, while the output of AND circuit 37 is connected to inverted reset signal terminal $\overline{R}$ of the shift register and to the input of a pulse generator 38. The output of pulse generator 38 is connected to the input of a logarithm function or exponential signal generating circuit 39 which has its output applied to a sample and hold circuit 40 and the latter further has a connection to the timing signal output terminal 36. The output of sample and hold circuit 40 is applied, as a control voltage, to a voltage controlled variable oscillator 41 which has its oscillation output applied to a modulating circuit 42 for amplitude modulation, in the latter, by an envelope signal applied to circuit 42 from an envelope signal generator 43. An RS flip-flop circuit 44 has an inverted set input terminal $\overline{S}$ connected with timing signal output terminal 36 and an inverted reset input terminal $\overline{R}$ connected with series output terminal OUT of shift register 33, and an output Q of flip-flop 44 is shown to be connected to an input of envelope signal generator 43 to cause operation of the latter in response to a high level "1" at the output Q due to setting of the flip-flop. Finally, the amplitude modulated oscillation output from circuit 42 is applied to an output terminal 45.

In a preferred embodiment of this invention, the logarithm function or exponential signal generating circuit 39 may have the circuit arrangement shown on FIG. 4 and which comprises an NPN transistor $Q_1$ and a PNP transistor $Q_2$. More particularly, in such circuit 39, resistors $R_1$ and $R_2$ are shown to be connected in series between an input terminal 39*a* of circuit 39 and the ground, with a junction or connection point between resistors $R_1$ and $R_2$ being connected to the base of transistor $Q_1$ which has its emitter connected to ground. The collector of transistor $Q_1$ is shown to be connected to a DC power supply $+V_{cc}$ through resistors $R_3$ and $R_4$, in series, with a junction or connection point between resistors $R_3$ and $R_4$ being connected to the base of transistor $Q_2$. The emitter of transistor $Q_2$ is shown to be directly connected to power supply $+V_{cc}$, while the collector of transistor $Q_2$ is connected to an output terminal 39*b* and also connected to ground through a parallel circuit of a resistor $R_5$ and a capacitor $C_1$.

When a positive pulse is applied to input terminal 39*a* of circuit 39 as described above with reference to FIG. 4, transistors $Q_1$ and $Q_2$ are both turned ON with the result that capacitor $C_1$ is charged and, therefore, the output voltage obtained at output terminal 39*b* is increased abruptly to the voltage of the power supply $+V_{cc}$. At the conclusion of the pulse applied to input terminal 39*a*, both transistors $Q_1$ and $Q_2$ are turned OFF so that the charge carried by capacitor $C_1$ is discharged through resistor $R_5$ and the voltage across capacitor $C_1$ decreases with a time constant which is determined by the capacitance of capacitor $C_1$ and the resistance of resistor $R_5$. Accordingly, a logarithm characteristic or function signal is obtained at output terminal 39*b* of circuit 39, and such signal is not influenced by changes in the ambient temperature.

Figures 5A, 5B, 5C, 5D, 5E, 5F, 5G:
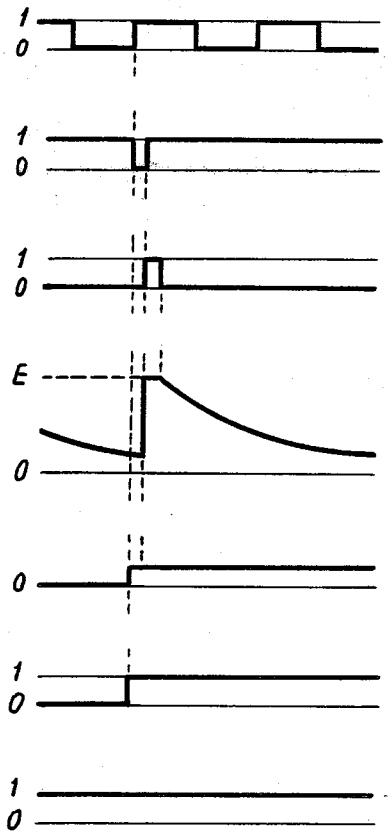

The operation of tone generator 30 according to this invention will now be described with reference to FIGS. 5A–5G and FIGS. 6A–6G which respectively show the waveforms of signals at various locations in tone generator 30 for the situation where one of the array 31 of key-operated switches has been actuated or closed, and for the situation where none of the switches have been actuated:

As is shown on FIGS. 5A and 6A, the clock signal or pulse supplied from oscillator 34 to clock signal input terminal C of shift register 33 has a rectangular waveform with a 50% duty cycle. As previously noted, the frequency of the clock pulse or signal is preferably relatively high, for example, of the order of 50 KHz so as to have a period of 20 microseconds. The series output terminal OUT and parallel output terminals $O_a$, $O_b$, - - - $O_n$ of shift register 33 are normally at the high level "1" and, at the commencement of an operating cycle of shift register 33 in response to the resetting of the latter, a signal at the low level "0" is applied from ground to series input terminal IN of the shift register so as to be shifted from left to right along the successive parallel output terminals $O_a$, $O_b$, - - - $O_n$ in response to the successive clock pulses from oscillator 34. Thus, in the event that none of the switches 31*a*, 31*b*, - - - 31*n* has been actuated or closed, the signal at the low level "0" will eventually appear at the series output terminal OUT and will be supplied therefrom to the respective input of AND circuit 37. When none of the switches in array 31 has been actuated or closed, the relatively high level "1" will be continuously supplied from DC power supply $+V_{cc}$ through resistor 35 and timing signal terminal 36 to the other input of AND circuit 37 so that, in response to the low level "0" at series output terminal OUT, AND circuit 37 produces an output signal at the low level "0" which is applied to the inverted reset signal input terminal $\overline{R}$ of switch register 14 for resetting the latter. In response to such resetting of shift register 33, the signal at the series output terminal OUT is returned to the level "1" (FIG. 6G), and the shifting of a signal at the low level "0" is again started from series input terminal IN past parallel output terminals $O_a$, $O_b$, - - - $O_n$ for changing the levels at such parallel output terminals from the normal high level "1" to the low level "0", in sequence.

When the level at series output terminal OUT of shift register 33 is returned to the level "1" in response to resetting of the shift register, the simultaneous application of the high levels "1" from timing signal output terminal 36 and series output terminal OUT to the respective inputs of AND circuit 37 causes the output of the latter to return to the level "1" which, in turn, causes pulse generator 38 to produce a positive trigger pulse signal (FIG. 6C). In other words, when none of the switches of array 31 is actuated or closed in response to operation of the respective key, the series output terminal OUT of shift register 33 provides a negative pulse (FIG. 6G) at the conclusion of each full operating cycle of shift register 33, with shift register 33 being reset at the falling side of such negative pulse and pulse generator 38 being actuated at the rising side of the negative pulse for providing the positive trigger pulse (FIG. 6C).

As shown, the positive trigger pulse from pulse generator 38 may have a rectangular waveform of a predetermined width, for example, in dependence on the time constant of a mono-multivibrator which forms pulse generator 38. The application of the positive trigger pulse from pulse generator 38 to the input 39*a* of the logarithm function signal or exponential voltage generator 39 causes the output voltage at terminal 39*b* to abruptly rise to the voltage E of power supply $+V_{cc}$, as shown on FIG. 6D. At the termination of the positive trigger pulse signal (FIG. 6C), the output voltage from generator 39 decreases slowly with an exponential characteristic (FIG. 6D). Accordingly, when none of the switches of array 31 is actuated or closed by depressing of the respective key, the exponential voltage generator 39 is synchronized with the operating cycle of the timing signal generator 32, that is, each exponential voltage signal (FIG. 6D) from generator 39 is initiated in synchronism with the occurrence of the low level "0" at the series output terminal OUT of shift register 33.

When none of the switches of array 31 is closed or actuated, the timing signal output terminal 36 remains at the high level "1" throughout each of the successive operating cycles of shift register 33 (FIG. 6B) so that sample and hold circuit 40 remains inoperative to sample the exponential voltage signal from generator 39. Therefore, the output voltage of circuit 40 remains at the low level "0" (FIG. 6E) so that the voltage controlled oscillator 41 does not oscillate. Further, the inverted reset input terminal $\overline{R}$ of RS flip-flop circuit 44 receives the negative pulse or "0" level signal from the series output terminal OUT of shift register 33 at the completion of each operating cycle of the latter so that flip-flop 44 is reset to provide the low level or "0" signal (FIG. 6F) at its output. So long as none of the switches of array 31 is actuated or closed, the continuous high level "1" signal from timing signal output terminal 36 is applied to the inverted set input terminal $\overline{S}$ of RS flip-flop circuit 44 so as to maintain the output Q of flip-flop circuit 44 at the low level "0" which does not trigger the envelope signal generator 43. Accordingly, the amplitude modulating circuit 42 is not supplied with either a signal from voltage controlled oscillator 41 or a signal from envelope signal generator 43, with the result that no output signal appears at output terminal 45.

On the other hand, in the event that any one of the switches in array 31, for example, the switch 31*b*, is closed or actuated by operation of the respective key, then a low level or "0" signal is provided at timing signal output terminal 36 through the closed switch 31*b* at such time as the low level or "0" signal appears at the respective parallel output terminal $O_b$ during the shifting of such low level signal from left to right in shift register 33. When the low level "0" signal appears at terminal 36, and hence at the respective input of AND circuit 37, a low level or "0" signal is provided at the output of AND circuit 37 and is supplied to the inverted reset input terminal $\overline{R}$ of shift register 33 so as to reset the latter without regard to the level then provided at the series output terminal OUT of shift register 33. Thus, when any one of the switches in array 31 is actuated or closed, a negative pulse or timing signal is provided at terminal 36 (FIG. 5B), with such timing signal occurring at a time during the operating cycle of shift register 33 which corresponds to the position of the respective actuated switch in array 31.

It will be appreciated that, when none of the switches in array 31 is actuated or closed, the repetitive operating cycle of shift register 33 corresponds to the number of clock pulses from oscillator 34 required for shifting the low level or "0" signal from the serial input terminal IN to the serial output terminal OUT. Thus, for example, if the keyboard of an electrical music instrument has fifty keys so that array 31 similarly includes fifty switches, the sweep time of shift register 33, that is, the time required for completion of its operating cycle when no switches are closed, is 1.0 millisecond in the case where the clock pulse oscillator has a frequency of 50 KHz, as previously indicated. Since the minimum time for which an operator of the music instrument can depress any one of the keys is not normally less than, for example, 10.0 milliseconds, it is clear that more than ten operating cycles of shift register 33 occur during the minimum time that any one of the keys is depressed. Of course, so long as any one of the keys is depressed so as to close the respective switch of array 31, each operating cycle of shift register 33 is of reduced duration, that is, shift register 33 is reset whenever the low level or "0" signal reaches the parallel output terminal of the shift register associated with the closed switch of array 31.

At the rising side of the negative pulse (FIG. 5B) from timing signal output terminal 36, that is, when shift register 33 has been reset in response to the application of the low level "0" signal from the output of AND circuit 37 to inverted reset terminal $\overline{R}$ of shift register 33, the output of AND circuit 37 returns to the high or "1" level to actuate pulse generator 38 and cause the latter to apply a trigger pulse (FIG. 5C) by which logarithm function signal generator 39 is made to produce an exponential voltage signal (FIG. 5D).

In the meantime, the negative pulse (FIG. 5B) from timing signal output terminal 36 is also applied to sample and hold circuit 40 so as to cause the latter to sample the exponential voltage signal from generator 39 at the falling side of the negative pulse. Thereafter, for so long as a particular key is depressed for closing the respective switch in array 31, circuit 40 will hold a particular sampled value of the exponential voltage (FIG. 5E) which corresponds to the closed or actuated switch. Such DC voltage (FIG. 5E) from sample and hold circuit 40 is applied, as a control voltage, to voltage controlled oscillator 41 so that the latter emits an oscillation signal with a frequency corresponding to the operated key.

The negative pulse appearing at timing signal output terminal 36 is also applied to the inverted set input terminal $\overline{S}$ of the RS flip-flop circuit 44 so that the level at the output terminal Q of such flip-flop circuit changes from the low level "0" to a high level "1" (FIG. 5F). In response to such high level "1" from flip-flop 44, envelope signal generator 43 is triggered to produce an envelope signal, for example, having the waveform shown on FIG. 2, and which is supplied to modulating circuit 42 for therein amplitude modulating the oscillation output obtained from variable or voltage controlled oscillator 41. Accordingly, modulating circuit 42 delivers to output terminal 45 an output signal or tone having the frequency and tone quality corresponding to the depressed key.

It will be seen that, so long as any one of the switches in array 31 is actuated or closed, the series output terminal OUT of shift register 33 remains at the high level "1" (FIG. 5G) so that, after flip-flop circuit 44 has been set to provide the high level "1" signal at its output (FIG. 5F), such high level output of flip-flop 44 is maintained and, accordingly, the envelope signal generator 43 continues to generate the respective envelope signal. Thus, so long as a key is depressed or operated for closing the respective switch of array 31, an oscillation output of the desired frequency and tone quality is obtained at output terminal 45.

When a key which has been depressed is released, the respective one of the switches in array 31 returns to its normal open condition with the result that, thereafter, the voltage at timing signal output terminal 36 remains at the high level "1" due to the connection through resistor 35 to the DC power supply. However, as previously mentioned, at the completion of the operating cycle or sweep of shift register 33 in which the previously closed switch is returned to its open condition, a negative pulse or low level "0" appears at series output terminal OUT of the shift register, with the result that the shift register is reset and, thereafter, the operation of tone generator 30 continues in the manner described above for the condition where no switch in array 31 is closed.

It will be appreciated that, as switches 31*a*, 31*b*, - - - 31*n* are selectively closed in any desired successive order, each of the exponential signals from generator 39 is synchronized with the resetting of shift register 33 at the commencement of an operating cycle of the latter, and the successive exponential signals are sampled by circuit 40 at times dependent on the positions of the successively closed switches in array 31. Thus, the values of the exponential signals successively sampled and held in circuit 40 depend on the positions of the successively closed switches in array 31 to provide output oscillations from the voltage controlled oscillator 41 which similarly depend upon the selectively actuated switches.

It will be appreciated that, in the tone generator 30 according to this invention, as described above, the exponential characteristic of the signal from generator 40 is dependent upon the resistance value of resistor $R_5$ and the capacitance of capacitor $C_1$ (FIG. 4) which do not vary with changes in temperature, so that the frequency of each output signal or tone obtained at terminal 45 is also independent of temperature. Further, since the timing signals provided at terminal 36 of timing signal generator 32 are digital signals which occur at times dependent on the positions of the closed switches in array 31, it is apparent that chattering of the switches cannot adversely affect the operation of tone generator 30.

However, in the tone generator 30 described with reference to FIG. 3, priority is given to a relatively high tone frequency which results from actuation or closing of a switch at the left-hand side of array 31. In other words, if two of the switches, for example, the switch 31*b* and 31*n*, are simultaneously closed, the output obtained at terminal 45 will have a relatively high frequency corresponding to the switch 31*b* even though the closing of the switch 31*n* may have occurred later than the closing of the switch 31*b*. As previously mentioned, it is desirable that priority not be given to either the high frequency or the low frequency tones, and that, in a single-tone electrical music instrument, the output frequency should correspond to the switch which is closed latest in the case where two or more switches are simultaneously closed. A tone generator 130 according to the present invention which operates in that preferred manner will now be described with reference to FIG. 7 in which parts corresponding to those described above with reference to FIG. 3 are identified by the same reference numerals and will not be further described in detail.

In the tone generator 130, the series output terminal OUT of shift register 33 is shown to be connected directly to the inverted reset input terminal $\overline{R}$ of shift register 33, and also to be connected directly to the input of exponential signal generator 39. As in the first-described embodiment of the invention, in the tone generator 130, the output of exponential signal generator 39 is connected to a sample and hold circuit 41 which, in this case, is actuated by a trigger pulse from a pulse generator 38', and the sampled voltage value from circuit 40 is applied, as a control voltage, to a voltage controlled oscillator 41 which supplies its oscillation output to a modulation circuit 42. The modulation circuit 42 further receives an envelope signal generator 43 and is operative to amplitude modulate the oscillation output of oscillator 41 with the envelope signal from generator 43 and thereby supply an output or tone of desired frequency and quality to the output terminal 45.

The tone generator 130 according to this invention is further shown to generally comprise a discriminating circuit 46 for determining whether one or more of the switches of array 31 is closed, and a detecting circuit 47 for detecting whether a switch of array 31 which is closed or actuated during one sweep of shift register 33 was closed during the preceeding sweep of the shift register.

Figure 7:
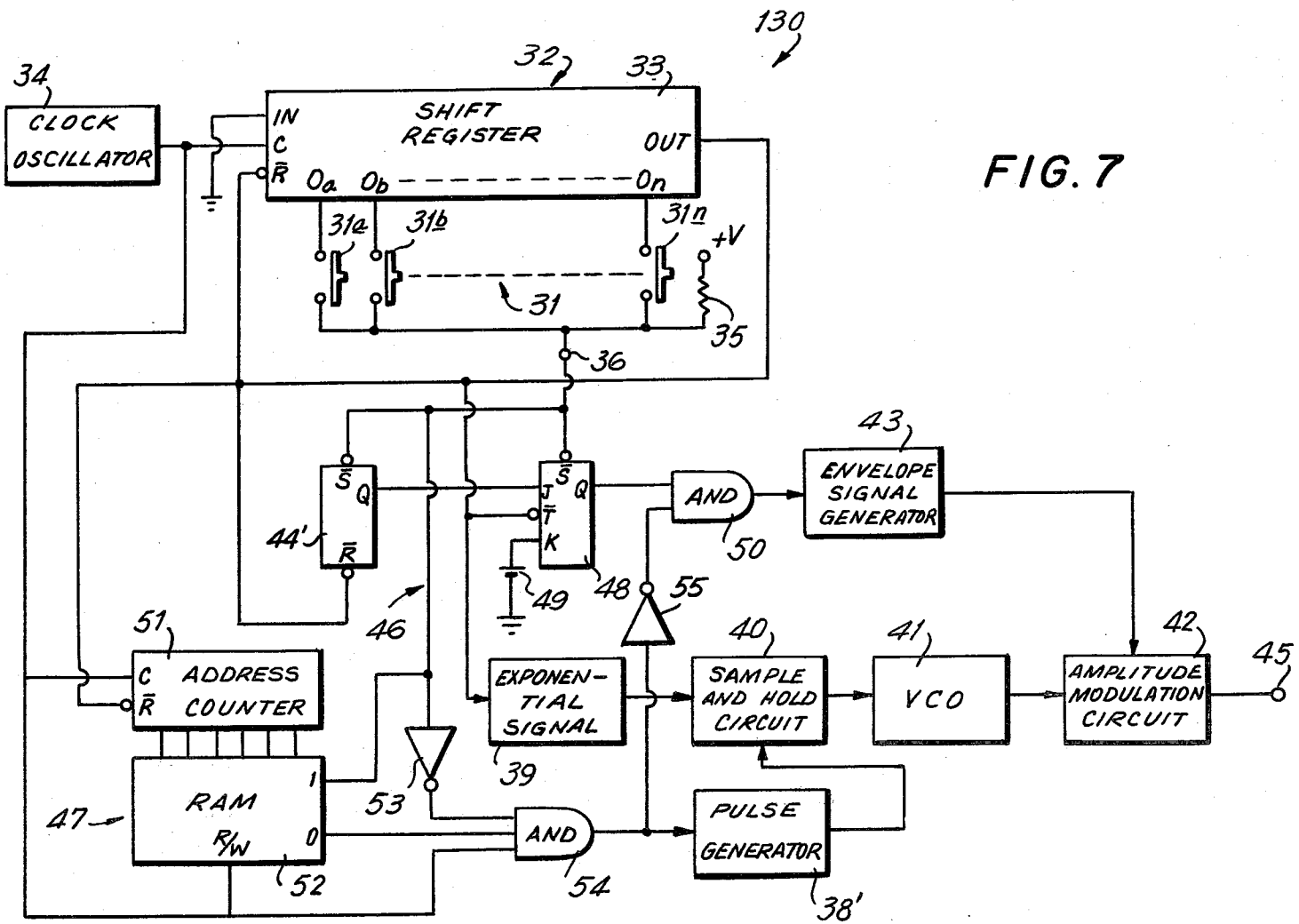
FIG. 7 is a block diagram showing a tone generator for an electrical music instrument according to another embodiment of this invention.

In the embodiment of the invention illustrated on FIG. 7, the discriminating circuit 46 is shown to include an RS flip-flop circuit 44' and a JK flip-flop circuit 48. The circuit 44' is shown to have an inverted set input signal terminal $\overline{S}$ connected to the timing signal output terminal 36 and an inverted reset input signal terminal $\overline{R}$ connected to the series output terminal OUT of shift register 33. The JK flip-flop circuit 48 also has an inverted set input terminal $\overline{S}$ connected to timing signal output terminal 36, a $\overline{T}$ input terminal connected to the series output terminal OUT of the shift register, a J input terminal connected to the output terminal Q of flip-flop circuit 44', and a K input terminal which continuously receives a high level "1" signal from a DC source 49. The output terminal Q of JK flip-flop circuit 48 is connected to one input of an AND circuit 50 which has its output connected to envelope signal generator 43 for causing the latter to produce an envelope signal in response to the rising of the output of AND circuit 50 from "0" to "1".

The detecting circuit 47 is shown to generally comprise an address counter 51 and a random access memory 52 which is hereinafter referred to as an RAM. The series output terminal OUT of shift register 33 is connected to an inverted reset input terminal $\overline{R}$ of address counter 51, while the clock pulse or output of clock oscillator 34 is applied to a clock signal input terminal C of the address counter. The address counter 51 is operative to address RAM 52 by a binary code signal of n bits, in which n is selected so that $2^n$ is close to the number of switches in array 31. Thus, for example, in the case where the array 31 contains fifty switches, the number n may be 6 so that $2^n=64$.

Figure 8A:
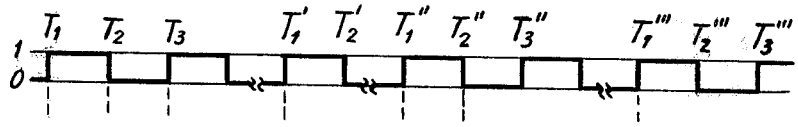
FIGS. 8A–8I are waveform diagrams to which reference will be made in explaining the operation of the tone generator shown on FIG. 7.

The output of clock oscillator 34 is also applied to a read and write control input terminal R/W of RAM 52 so that the latter is in its reading and writing states or conditions in response to the levels "1" and "0", respectively, of the clock pulse (FIG. 8A). The timing signal output terminal 36 is further shown to be connected to an input terminal I of RAM 52 and through an inverter 53 to a first input of an AND circuit 54 which further has second and third inputs connected to the output O of RAM 52 and to the clock oscillator 34, respectively. Finally, the output of AND circuit 54 is connected to the input of pulse generator 38' and, through an inverter 55, to a second input of AND circuit 50.

The operation of the tone generator according to this invention will now be described in detail, assuming that the clock pulse from oscillator 34 has a 50% duty cycle, as shown on FIG. 8A, and further that all of the switches in array 31 are initially open. Upon the closing of one of the switches in array 31, for example, the switch 31*a*, by operation of the respective key, a corresponding negative timing signal of rectangular form (FIG. 8B) is provided at timing signal output terminal 36. Such timing signal falls down at the time $T_1$ and rises at the time $T_3$ which define the interval of time during which a low or "0" level is provided at the corresponding parallel output terminal Oa of shift register 33. The negative rectangular signal from timing signal output terminal 36 (FIG. 8B), when applied to the inverted set input terminal $\overline{S}$ of each of the flip-flops 44' and 48 causes setting thereof so that the output Q of each of the flip-flops 44' and 48 rises from "0" to "1" at the time $T_1$, as shown on FIG. 8D. At the time when a timing signal is obtained from terminal 36, the series output terminal OUT of shift register 33 is at the relatively high level "1", as shown on FIG. 8C. However, due to the fact that the output Q of set flip-flop 44' is at the level "1" and is applied to the J input of JK flip-flop 48, and further due to the fact that the input K of flip-flop 48 always receives the relatively high level "1" from voltage source 49, flip-flop 48 is conditioned so that the next trigger or negative pulse applied to input $\overline{T}$ from the series output terminal OUT of shift register 33 at the completion of a sweep or operating cycle of the latter will provide a toggle action on flip-flop 48, by which the output Q of the latter will be returned from "1" to "0" at the completion of an operating cycle of the shift register. It will also be appreciated that the application to inverted reset input terminal $\overline{R}$ of flip-flop 44' of a negative pulse from the series output terminal OUT of shift register 33 at the end of each sweep or operation cycle of the latter will cause resetting of flip-flop 44' so that the output Q of flip-flop 44' will be returned to the "0" level, for example, as at the time $T'_1$ on FIG. 8D.

Simultaneously with the setting of flip-flop 48 by a negative timing signal from terminal 36 corresponding to the closed switch 31*a*, the code from counter 51 activates the address in RAM 52 which corresponds to the closed switch 31*a*. In the time period from $T_1$ to $T_2$, the clock pulse from oscillator 34 (FIG. 8A) causes reading operation of RAM 52 by which there is obtained, at the output O of RAM 52, a signal at the high level "1" indicating that the switch 31*a* corresponding to the activated address was not closed during the preceding operating cycle or sweep of shift register 33. Simultaneously with the application to AND circuit 54 of a signal at the level "1" from the output O of RAM 52, the negative timing signal from terminal 36 due to closing of switch 31*a* is applied through inverter 53 as a high level signal "1" to the respective input of AND circuit 54 which is further receiving a high level signal "1" from clock oscillator 34. Thus, the output of AND circuit 54 rises from "0" to "1" at the time $T_1$ and remains at such high level until the time $T_2$ (FIG. 8E) to signify that the switch 31*a* which is closed during the current sweep or operating cycle of shift register 33 was not closed during the preceding sweep or operating cycle of the shift register.

When the output of AND circuit 54 (FIG. 8E) rises from "0" to "1" at the time $T_1$, pulse generator 38' is actuated thereby to provide a trigger pulse or sampling signal (FIG. 8G) which is supplied to the sampling signal input of sampling and hold circuit 40 so as to cause the latter to sample and hold the then existing value of the exponential output signal (FIG. 8H) from the exponential signal generator 39 which is synchronized with the negative pulse from series output terminal OUT of shift register 33 occurring at the conclusion of each sweep or operating cycle. The sampled value of the exponential signal is applied, as a control voltage, from circuit 40 to voltage controlled oscillator 41 so as to determine the frequency of the oscillation output applied to modulating circuit 42.

The output of AND circuit 54, which is at the level "1" in the interval $T_1$–$T_2$ (FIG. 8E) so as to indicate that the timing signal (FIG. 8B) then being obtained from terminal 36 represents a closed one of the switches **31*a*–31*n* that was not closed during a prior sweep, is applied as a negative pulse through inverter 55 to the respective input of AND circuit 50. Thus, although the output Q of flip-flop 48 is at the level "1", the output of AND circuit 50 remains at the level "0" in the interval $T_1$–$T_2$ by reason of the low level of the input from inverter 55. However, at the time $T_2$, the clock pulse from oscillator 34 goes down (FIG. 8A) so that the output of AND circuit 54 similarly goes from "1" to "0" (FIG. 8E). Therefore, at the time $T_2$, inverter 55 applies a signal at the level "1" to the respective input of AND circuit 50 and the output of the latter rises to the level "1" (FIG. 8F) so as to cause envelope signal generator 43 to produce an envelope signal. As in the previously described embodiment of the invention, the envelope signal from generator 43 acts, in modulating circuit 42, to amplitude modulate the oscillation output of voltage controlled oscillator 41, and thereby provide an output or tone signal of the desired frequency and quality at output terminal 45**.

At the completion of the sweep or operating cycle of shift register 33, the negative pulse or low level signal "0" (FIG. 8C) from series output terminal OUT is effective at terminal $\overline{T}$ of JK flip-flop 48 to provide a toggle action since terminals J and K are then both at the relatively high level "1", whereby output Q of flip-flop 48 is changed from "1" to "0". The negative pulse from series output terminal OUT of shift register 33 also acts at inverted reset terminal $\overline{R}$ of flip-flop 44' to reset the latter and thereby change its output Q from "1" back to "0". Finally, the negative pulse from the series output terminal OUT of shift register 33 triggers exponential signal generating circuit 39 so as to synchronize the exponential signal (FIG. 8H) with the completion of the sweep or operating cycle of the shift register, as previously noted.

If the same key, for example, the key associated with switch **31*a*, continues to be depressed in successive sweeps or operating cycles of shift register 33, the signal read from the respective address and available at output O of RAM 52 for application to the respective input of ANd circuit 54 will be at the low level "0" showing that switch 31*a* was previously memorized as being closed whenever, in each of the successive sweeps of the shift register, the negative timing signal representing the closed switch 31*a* is applied through inverter 53 as a high level signal "1" to the respective input of AND circuit 54. Thus, the output of AND circuit 54 will remain at the low level "0" and pulse generator 38' will not be actuated to provide a sampling or trigger pulse to sample and hold circuit 40. Accordingly, so long as the same key, for example, the key associated with switch 31*a*, remains depressed during successive sweeps of shift register 33, the voltage sampled and held by circuit 40 during the initial sweep of the shift register in which switch 31*a* was closed, will continue to be applied to voltage controlled oscillator 41 with the result that the frequency of the output signal or tone obtained at terminal 45** will remain unchanged.

Figure 8B:
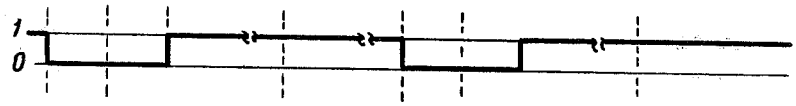
Figure 8C:
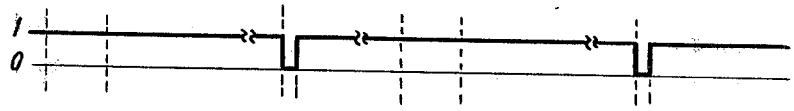
Figure 8D:
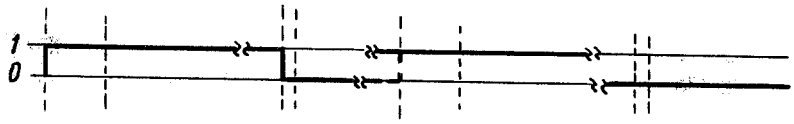
Figure 8E:
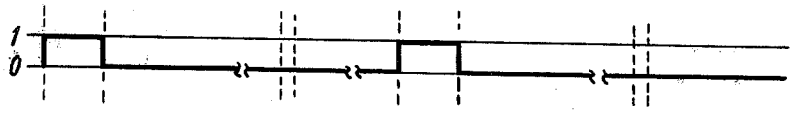

If another switch, for example, switch **31*n*, is closed or actuated at a time when the previously actuated switch 31*a* is still in its closed condition, for example, as in legato playing of the instrument, then, during the first sweep of shift register 33 following the closing of switch 31*n*, there will be obtained at terminal 36 a negative timing signal corresponding to the previously closed switch 31*a* which falls down at the time $T_1$ and rises at the time $T_3$, and another negative timing signal or pulse corresponding to the newly closed switch 31*n* and which falls down at the time $T_1''$ and rises up at the time $T''_3$ (FIG. 8B). Since the switch 31*a* had been closed during one or more earlier sweeps or operating cycles of shift register 33, AND circuit 54 will not provide an output at the high level "1" in response to the timing signal corresponding to closed switch 31*a* with the result that pulse generator 38' will not be actuated at the time in the cycle corresponding to the position of switch 31*a* in array 31. However, when the timing signal due to closed switch 31*n* is obtained at terminal 36 during the first sweep in which switch 31*n* has been closed, the signal read from the corresponding address in RAM 52 and applied from output O of the latter to the corresponding input of AND circuit 54 will be at the high level "1" for indicating that the switch 31*n* was not closed in a preceding sweep or operating cycle of the shift register. Since the timing signal corresponding to closed switch 31*n* will, as a result of inverter 53, appear as a signal at the high level "1" at the respective input of AND circuit 54 at a time when the clock pulse from oscillator 34 is also at the level "1", AND circuit 54 will provide an output at the level "1" between the times $T''_1$ and $T''_2$ (FIG. 8E). Such output from AND circuit 54 will trigger or actuate pulse generator 38' at time $T''_1$ so as to cause circuit 40 to sample and hold the voltage value of the exponential signal from circuit 39 at the time corresponding to closed switch 31*n*. Such sampled and held voltage value (FIG. 8I) is applied, as the control voltage, to voltage controlled oscillator 41 so as to change the frequency of the oscillation output of the latter to the frequency corresponding to the position of the latest actuated or closed switch 31*n* in the array 31 of the switches. As previously described, due to the transmission of the output of AND circuit 54 through inverter 55 to a respective input of AND circuit 50, the output of the latter falls down to "0" from "1" at the time $T''_1$ and rises again to the value "1" at the time $T''_2$ (FIG. 8F) so that envelope signal generating circuit 43 is actuated to supply an envelope signal to modulating circuit 42 at the time $T''_2$ corresponding to the timing signal resulting from closed switch 31*n*. Accordingly, the output signal or tone now obtained at terminal 45 has a frequency corresponding to closed switch 31*n* and a quality determined by the envelope signal from circuit 43. Thus, although switches 31***a* and 31*n* are closed for periods that overlap, the frequency of the output signal is determined by the switch which is later closed, as is desired in the case of a single-tone electrical music instrument.

Figure 8F:
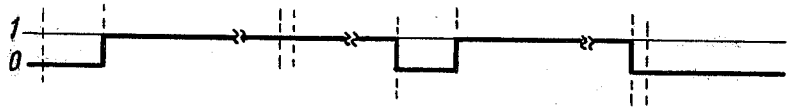
Figure 8G:
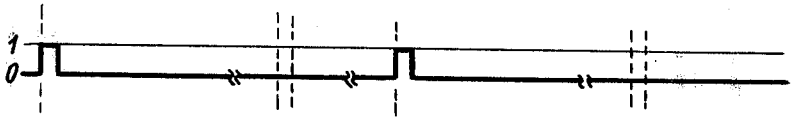
Figure 8H:
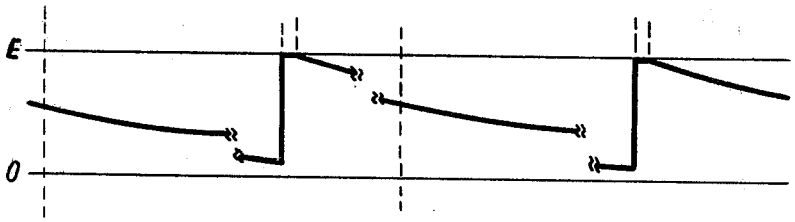
Figure 8I:
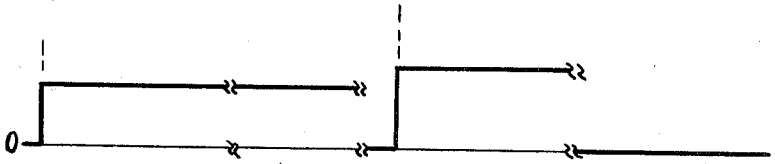

When all of the switches 31*a*–31*n* are returned to their normal open positions, for example, by releasing all of the respective keys of the keyboard, no negative pulses or timing signals are obtained at terminal 36 during the successive sweeps or operating cycles of shift register 33. However, at the completion of each sweep or operating cycle of shift register 33, a negative pulse which falls down at the time $T'''_1$ and rises after a predetermined short time, is obtained from series output terminal OUT of the shift register (FIG. 8C). Such negative pulse appearing at the time $T''_1$ and applied to the terminal $\overline{T}$ of flip-flop 48 causes an immediate toggle action by which the output Q of flip-flop 48 goes from "1" to "0" for similarly abruptly changing the output level of AND circuit 50 (FIG. 8F). Thus, operation of the envelope signal generating circuit 43 is halted. Further, at the conclusion of the first sweep of shift register 33 with none of the switches 31*a*–31*n* being closed, the negative pulse from series output terminal OUT of the shift register is applied to the inverted reset terminal $\overline{R}$ of flip-flop 44' to reset the latter so that its output Q returns to the level "0". Thereafter, the terminals J and K of flip-flop 48 are at the "0" and "1" levels during successive sweeps of shift register 33 with none of the switches closed, so that each negative pulse from the series output terminal OUT of the shift register acts at terminal $\overline{T}$ of flip-flop 48 merely to reset the latter for ensuring that the output Q of flip-flop 48 remains at the low level "0".

Although the negative pulse from the series output terminal OUT of shift register 33 occurring at the end of each sweep thereof with all of the switches 31*a*–31*n* being open is effective to trigger or actuate exponential signal generating circuit 39 (FIG. 8H), the timing signal terminal 36 remains at the high level "1" with the result that inverter 53 applies a low level signal "0" to the respective input of AND circuit 54. Therefore, there is no high level output from AND circuit 54 to actuate pulse generator 38' and thereby provide a sampling pulse or signal to circuit 40. Accordingly, sample and hold circuit 40 is inoperative to sample the exponential signal from circuit 39, and the output of circuit 40 is reduced to "0" near the time $T'''_1$ (FIG. 8I) so that voltage controlled oscillator 41 is rendered inoperative and no output is obtained from terminal 45.

It will be appreciated that the tone generator 130 according to this invention described with reference to FIG. 7 has all of the advantageous characteristics previously ascribed to the tone generator 30 of FIG. 3 and, in addition thereto, ensures that the frequency of the output signal or tone at terminal 45 will correspond to the last closed switch of array 31 when two or more of those switches are closed for overlapping periods.

Although illustrative embodiments of this invention have been described in detail herein with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A tone generating apparatus for an electrical music instrument comprising:

an array of switches corresponding to respective keys of a keyboard and which are selectively actuable by manipulation of the respective keys;

timing signal generating means having a repetitive operating cycle and being connected with said switches for providing timing signals in response to actuation of said switches, with each of said timing signals occurring at a time during said operating cycle which corresponds to the position in said array of the respective actuated switch;

exponential signal generating means for providing an exponential signal the value of which varies exponentially as a function of the length of time since the start of each said operating cycle of the timing signal generating means;

sample and hold means receiving said exponential signal and being operative to sample and hold a value of said exponential signal in dependence on the time of occurrence of one of said timing signals in said operating cycle; and variable frequency oscillating means controlled in accordance with said value of the exponential signal which is sampled and held for providing an output oscillation having a frequency determined by a selectively actuated one of said switches.

2. A tone generating apparatus for an electrical music instrument according to claim 1; further comprising modulating means receiving said output oscillation, and envelope signal generating means operative to apply an envelope signal to said modulating means for amplitude modulating said output oscillation therewith.

3. A tone generating apparatus for an electrical music instrument according to claim 2; further comprising means to effect operation of said envelope signal generating means only when at least one of said switches has been actuated.

4. A tone generating apparatus for an electrical music instrument according to claim 3; in which said means to effect operation of said envelope signal generating means includes flip-flop means which is set in response to the first timing signal occurring in each said operating cycle and reset in response to the conclusion of each operating cycle, said flip-flop means having an output which triggers operation of said envelope signal generating means upon the setting of said flip-flop means.

5. A tone generating apparatus for an electrical music instrument according to claim 3; further comprising detecting means operative, when a plurality of said switches are actuated simultaneously, to detect which of the simultaneously actuated switches is the latest to be actuated and to trigger said envelope signal generating means in response to the timing signal corresponding to said latest actuated switch.

6. A tone generating apparatus for an electrical music instrument according to claim 5; in which said detecting means includes memory means having a plurality of addresses corresponding to said switches, respectively, and at which, in each of said operating cycles, a signal identifying the state of the respective switch during the current operating cycle is written and a signal identifying the start of the respective switch during the preceding operating cycle is read, and logic means responsive to a difference in the signals being written and read at any one of said addresses to detect the respective one of the switches as said latest actuated switch.

7. A tone generating apparatus for an electrical music instrument according to claim 6; in which said logic means includes an AND circuit having first and second inputs to which the signals being written and read, respectively, are applied, and inverting means acting on one of said signals being applied to an input of said AND circuit so that the latter provides an output only when said signals being written and read at an address of said memory means identify different states of the respective switch.

8. A tone generating apparatus for an electrical music instrument according to claim 7; further comprising means for affecting operation of said sample and hold means in response to said output of the AND circuit.

9. A tone generating apparatus for an electrical music instrument according to claim 1; further comprising detecting means operative, when a plurality of said switches are actuated simultaneously, to detect which of the simultaneously actuated switches is the latest to be actuated, and means responsive to said detecting means to operate said sample and hold means only at the time of occurrence of the latest to be actuated switch.

10. A tone generating apparatus for an electrical music instrument according to claim 9; in which said detecting means includes memory means having a plurality of addresses corresponding to said switches, respectively, and at which, in each of said operating cycles, a signal identifying the state of the respective switch during the current operating cycle is written and a signal identifying the state of the respective switch during the preceding operating cycle is read, and logic means responsive to a difference in the signals being written and read at any one of said addresses to detect the respective one of the switches as said latest actuated switch.

11. A tone generating apparatus for an electrical music instrument according to claim 10; in which said logic means includes an AND circuit having first and second inputs to which the signals being written and read are applied, and inverting means acting on one of said signals being applied to an input of said AND circuit so that the latter provides an output only when said signals being written and read at an address of said memory means identify different states of the respective switch.

12. A tone generating apparatus for an electrical music instrument according to claim 11; in which said means to operate said sample and hold means includes a pulse generator made operative by said output of the AND circuit to provide a sampling pulse for said sample and hold means.

13. A tone generating apparatus for an electrical music instrument according to claim 9; further comprising modulating means receiving said output oscillation, envelope signal generating means operative to apply an envelope signal to said modulating means for amplitude modulating said output oscillation therewith, and means responsive to said detecting means to trigger said envelope signal generating means in response to the timing signal corresponding to said latest to be actuated switch.

14. A tone generating apparatus for an electrical music instrument according to claim 1; in which said timing signal generating means includes shift register means having parallel outputs respectively connected to said switches, a series input to which a timing pulse is admitted at the commencement of a sweep of said shift register, a reset input and a series output at which a series output signal is obtained at the completion of a sweep, and a clock pulse oscillator connected with said shift register means to cause a timing pulse admitted to said series input to sweep past said parallel outputs in sequence during repetitive operating cycles of said shift register, said timing signals provided in response to actuation of the switches being constituted by said timing pulse of the respective parallel outputs of the shift register.

15. A tone generating apparatus for an electrical music instrument according to claim 14; further comprising logic circuit means receiving said timing signals and said series output signal and being responsive to either said timing or series output signals for providing a reset signal to said reset input of the shift register means.

16. A tone generating apparatus for an electrical music instrument according to claim 14; in which said series output signal is applied to said reset input to initiate a new sweep of said shift register means on completion of each sweep of the latter.

* * * * *